US012799828B1

(12) United States Patent
Batarseh

(10) Patent No.: US 12,799,828 B1
(45) Date of Patent: Nov. 17, 2026

(54) CASING A WELLBORE WHILE DRILLING

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 19/206,344

(22) Filed: May 13, 2025

(51) Int. Cl.

| | |
|---|---|
| ***E21B 7/15*** | (2006.01) |
| ***E21B 21/00*** | (2006.01) |
| ***E21B 33/138*** | (2006.01) |
| ***E21B 36/04*** | (2006.01) |

(52) U.S. Cl.
CPC ..... *E21B 7/15* (2013.01); *E21B 21/00* (2013.01); *E21B 33/138* (2013.01); *E21B 36/04* (2013.01)

(58) Field of Classification Search
CPC ..... E21B 7/15; E21B 21/00; E21B 33/138; E21B 36/04; E21B 7/14
See application file for complete search history.

(56) References Cited

U.S. PATENT DOCUMENTS

| | | | | |
|---|---|---|---|---|
| 6,755,262 | B2 | 6/2004 | Parker | |
| 6,851,488 | B2 * | 2/2005 | Batarseh | E21B 7/14 175/11 |
| 9,562,395 | B2 | 2/2017 | Grubb et al. | |
| 11,149,499 | B1 * | 10/2021 | Batarseh | E21B 43/11 |
| 11,913,303 | B2 | 2/2024 | Batarseh | |
| 2004/0195003 | A1 * | 10/2004 | Batarseh | E21B 33/138 175/16 |
| 2004/0244970 | A1 | 12/2004 | Smith | |
| 2009/0126235 | A1 * | 5/2009 | Kobayashi | E21C 45/00 37/195 |
| 2012/0111578 | A1 | 5/2012 | Tverlid | |
| 2017/0275960 | A1 | 9/2017 | Linetskiy | |
| 2017/0312855 | A1 * | 11/2017 | Hooper | E21B 4/14 |
| 2020/0115962 | A1 * | 4/2020 | Batarseh | E21B 41/0078 |
| 2022/0325583 | A1 * | 10/2022 | Batarseh | E21B 7/04 |
| 2023/0203904 | A1 | 6/2023 | Aljubran et al. | |
| 2023/0407707 | A1 * | 12/2023 | Batarseh | E21B 7/15 |
| 2023/0407724 | A1 * | 12/2023 | Batarseh | E21B 7/14 |

(Continued)

FOREIGN PATENT DOCUMENTS

| | | | |
|---|---|---|---|
| WO | WO 2019217176 | A1 | 11/2019 |
| WO | WO 2023250009 | A1 | 12/2023 |

OTHER PUBLICATIONS

International Search Report and Written Opinion in Intl. Appln. No. PCT/US2025/043703, mailed on Jan. 22, 2026, 15 pages.

*Primary Examiner* — Daniel P Stephenson
(74) *Attorney, Agent, or Firm* — Fish & Richardson P.C.

(57) ABSTRACT

Systems and methods include a wellbore drilling assembly including a first laser head operable to emit a first laser beam in a downhole direction to cause portions of the subsurface formation to be released as drill cuttings into the wellbore and a second laser head operable to emit second laser beams at an angle relative to a central axis of the wellbore to cut angled holes into the sides of the wellbore. The second laser beams have a width that is less than a width of the first laser beam. A third laser head is disposed uphole from the first and second laser heads. The third laser head is operable to emit a third laser beam in a radial direction within the wellbore to cause material on a side wall of the wellbore to consolidate and form a casing of the wellbore.

16 Claims, 8 Drawing Sheets

(56) References Cited

U.S. PATENT DOCUMENTS

| | | | | |
|---|---|---|---|---|
| 2024/0309705 | A1* | 9/2024 | Mutairi | B23K 26/106 |
| 2024/0351139 | A1* | 10/2024 | Batarseh | B23K 26/1462 |
| 2025/0250886 | A1* | 8/2025 | Cavazos Sepulveda | E21B 33/1243 |

* cited by examiner

CASING A WELLBORE WHILE DRILLING

TECHNICAL FIELD

The present disclosure relates to casing a wellbore while drilling the wellbore.

BACKGROUND

Drilling operations in the oil and gas industry form wellbores that extend into a subsurface formation to access hydrocarbons contained within the subsurface formation. Well casing is installed in the wellbore to maintain stability and prevent collapsing and sanding of the wellbore. Well casing can protect the subsurface formation from contamination caused by the drilling operations, for example, contamination caused by drilling mud. Well casing can also provide a stable conduit for drilling fluids and equipment to travel up and down the wellbore.

The installation of casing typically occurs in several stages. Conductor casings are installed first and extend from the surface to a shallow depth. Cement can be pumped between the casing and the formation to form a cased hole. Next surface casing can be installed to prevent collapse in weak formations at shallow depths and to protect against shallow blowouts. Intermediate casing can be installed above or below an over-pressure zone to seal off severe-loss zones or guard against problematic formations. Production casing can be installed to isolate producing zones in the subsurface formation and control flow of reservoir fluid into the wellbore. Each stage of casing is progressively smaller. The last casing is the smallest and is installed with cement between the intermediate and the production casing.

SUMMARY

This disclosure describes an approach to casing a wellbore that simplifies the casing process and reduces the operational footprint of a casing operation. High-powered lasers can be used to control the phase of the rock of the subsurface formation that forms walls of the wellbore. The lasers can, for example, melt, spall or vaporize the rock. By using high-powered lasers to melt formation rock along the walls of the wellbore, the formation rock becomes a natural well casing. A laser tool can be attached to a bottom hole assembly to form the well casing while the wellbore is being drilled.

The described approach can include using multiple laser heads to drill the wellbore and to form a natural well casing by melting the rock. The natural well casing, in contrast to traditional well casing, can be formed from natural materials in the wellbore. The natural well casing can be formed in place in the wellbore to support the structural integrity of the wellbore and prevent contamination from entering the well or the subsurface formation. A first laser head can emit laser beams directed in the downhole direction to drill the wellbore. A second laser head can emit one or more laser beams at an angle to a central axis of the wellbore. The laser beams from the second laser head can form small, relative to the wellbore, holes that are angled in the downhole direction. These small, angled holes can be filled with melted rock that adheres to the well casing forming an anchor to maintain the well casing in position relative the sides of the wellbore. A third laser head can emit laser beams directed radially toward the sides of the wellbore. The laser beams from the third laser head can melt the rocks on the sides of the wellbore to form the well casing.

In an example implementation of this approach, a wellbore drilling assembly can include a first laser head configured to emit a first laser beam in a downhole direction within the wellbore to form the wellbore through a subsurface formation. Emitting the first laser beam in the downhole direction can cause portions of the subsurface formation to be released as drill cuttings into the wellbore. The drilling assembly can include a second laser head configured to emit second laser beams at an angle relative to a central axis of the wellbore. The second laser beams can have a width that is less than a width of the first laser beam. The second laser beams can be configured to cut angled holes into the side of the wellbore. The drilling assembly can include a third laser head uphole from the first and second laser heads. The third laser head can be configured to emit a third laser beam in a radial direction within the wellbore. The third laser beam, when incident on a side wall of the wellbore, causes material on the side wall to consolidate and form a casing of the wellbore.

Implementations of the systems and methods of this disclosure can provide various technical benefits. For example, these systems and methods reduce the operational surface footprint of casing operations at drilling locations. The described systems and methods can also reduce the amount of time that is spent on installing well casing decreasing the overall time to drill a well into the subsurface formation. The described systems and methods reduce material used for well casing and material costs by forming well casing from rock in place in the subsurface formation. The described systems and methods form an attachment or anchor to secure the natural well casing to the subsurface formation. Using a high-power laser to drill a wellbore can result in a straight and controlled wellbore because the laser is stress independent. High-powered lasers can also drill in many types of rock irrespective of the rock's compressive strength.

The details of one or more embodiments of these systems and methods are set forth in the accompanying drawings and the description below. Other features, objects, and advantages of these systems and methods will be apparent from the description and drawings, and from the claims.

DESCRIPTION OF DRAWINGS

Like reference symbols in the various drawings indicate like elements.

DETAILED DESCRIPTION

This disclosure describes an approach to casing a wellbore that simplifies the casing process and reduces the operational footprint of a casing operation. High-powered lasers can be used to control the phase of the rock of the subsurface formation that forms walls of the wellbore. The laser can, for example, melt, spall or vaporize the rock. By using high-powered lasers to melt formation rock along the walls of the wellbore, the formation rock becomes a natural well casing. A laser tool can be attached to a bottom hole assembly to form the well casing while the wellbore is being drilled.

The described approach can include using multiple laser heads to drill the wellbore and to form a natural well casing by melting the rock. The natural well casing, in contrast to traditional well casing, can be formed from natural materials in the wellbore. The natural well casing can be formed in place in the wellbore to support the structural integrity of the wellbore and prevent contamination from entering the well or the subsurface formation. A first laser head can emit laser beams directed in the downhole direction to drill the wellbore. A second laser head can emit one or more laser beams at an angle to a central axis of the wellbore. The laser beams from the second laser head can form small, relative to the wellbore, holes that are angled in the downhole direction. These small, angled holes can be filled with melted rock that adheres to the well casing forming an anchor to maintain the well casing in position relative the sides of the wellbore. A third laser head can emit laser beams directed radially toward the sides of the wellbore. The laser beams from the third laser head can melt the rocks on the sides of the wellbore to form the well casing.

Figure 1:
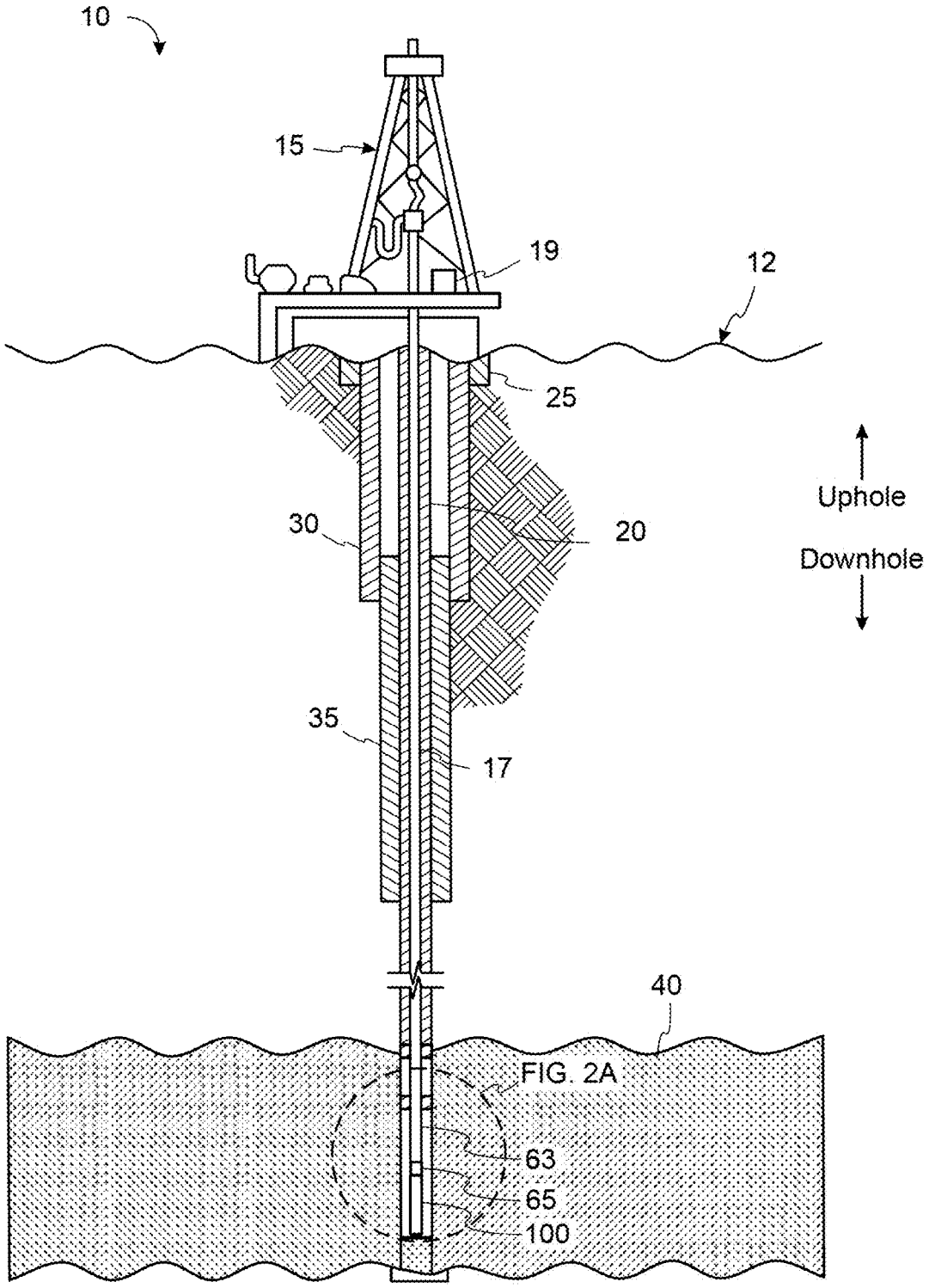
FIG. 1 is a schematic diagram of an example wellbore system that includes a downhole tool for casing a wellbore while drilling.

FIG. 1 is a schematic diagram of an example wellbore system 10 that includes at least one downhole tool 100 for casing a wellbore while drilling. As shown more specifically in FIGS. 2A-2C (which show a closer view of a portion of the wellbore system 10), the downhole tool 100 (e.g., a casing while drilling tool) can be installed on portions of a wellbore tubing string 17 that, among other components, is made up of pipe segments 63 that are coupled (for example, threadingly) together to form the string 17. The downhole tool 100 can be coupled to pipe segments 63 at joint 65.

The downhole tool 100 includes multiple laser heads that are operable to extend the wellbore and form natural well casing on the sides of the wellbore 20. The downhole tool 100 includes a main laser that can emit a laser beam in the downhole direction to extend the wellbore. A secondary laser head can emit laser beams in the downhole direction at an angle from the central axis 21 of the wellbore 20. The secondary laser head is operable to cut narrow holes in the subsurface formation to form anchors for the natural casing to retain the natural casing in place along the sides of the wellbore 20. A third laser head can emit laser beams in a radial direction to form the natural casing by melting or consolidating natural material in the wellbore 20.

As shown, the wellbore system 10 accesses a subsurface formation 40, and provides access to hydrocarbons located in the subsurface formation 40, also called reservoir 40. In an example implementation of system 10, the system 10 may be used for a drilling operation as well as a production operation to produce hydrocarbons through the wellbore tubular string.

As illustrated in FIG. 1, an implementation of the wellbore system 10 includes a rig assembly (or "assembly") 15 deployed on a surface 12. The assembly 15 can generally represent a drilling assembly that can be used to form the wellbore 20 extending from the surface 12 and through one or more geological formations in the Earth, as well as a production assembly to produce hydrocarbons, water, or both from the one or more geological formations. One or more subsurface formations, such as subsurface formation 40, are located under the surface 12. One or more wellbore casings, such as a surface casing 30 and intermediate casing 35, may be installed in at least a portion of the wellbore 20 (for example subsequent to completion of the drilling operation or some other time).

In some implementations, the assembly 15 may be deployed on a body of water rather than the surface 12. For instance, in some implementations, the surface 12 may be an ocean, gulf, sea, or any other body of water under which hydrocarbon-bearing formations may be found. In short, reference to the surface 12 includes both land and water surfaces and contemplates forming and developing one or more wellbore systems 10 from either or both locations.

Generally, as a drilling system, the assembly 15 may be any appropriate assembly or drilling rig used to form wellbores or boreholes in the Earth. The assembly 15 may use traditional techniques to form such wellbores, such as the wellbore 20, or may use nontraditional or novel techniques. In some implementations, the drilling assembly 15 may use rotary drilling equipment to form such wellbores. Rotary drilling equipment is known and may consist of a drill string and a drill bit (or bottom hole assembly that includes a drill bit). In some embodiments, the assembly 15 may consist of a rotary drilling rig. Rotating equipment on such a rotary drilling rig may consist of components that serve to rotate a drill bit, which in turn forms a wellbore, such as the wellbore 20, deeper and deeper into the ground. Rotating equipment consists of a number of components (not all shown here), which contribute to transferring power from a prime mover to the drill bit itself. The prime mover supplies power to a rotary table, or top direct drive system, which in turn supplies rotational power to the drill string. The drill string is typically attached to the drill bit (for example, as a bottom hole assembly). A swivel, which is attached to hoisting equipment, carries much, if not all of, the weight of the drill string, but may allow it to rotate freely.

In some implementations of the wellbore system 10, the wellbore 20 may be cased with one or more casings. As illustrated, the wellbore 20 includes a conductor casing 25, which extends from the surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the surface 12. The wellbore 20 may than extend vertically downward. This portion of the wellbore 20 may be enclosed by the intermediate casing 35.

Figure 2A:
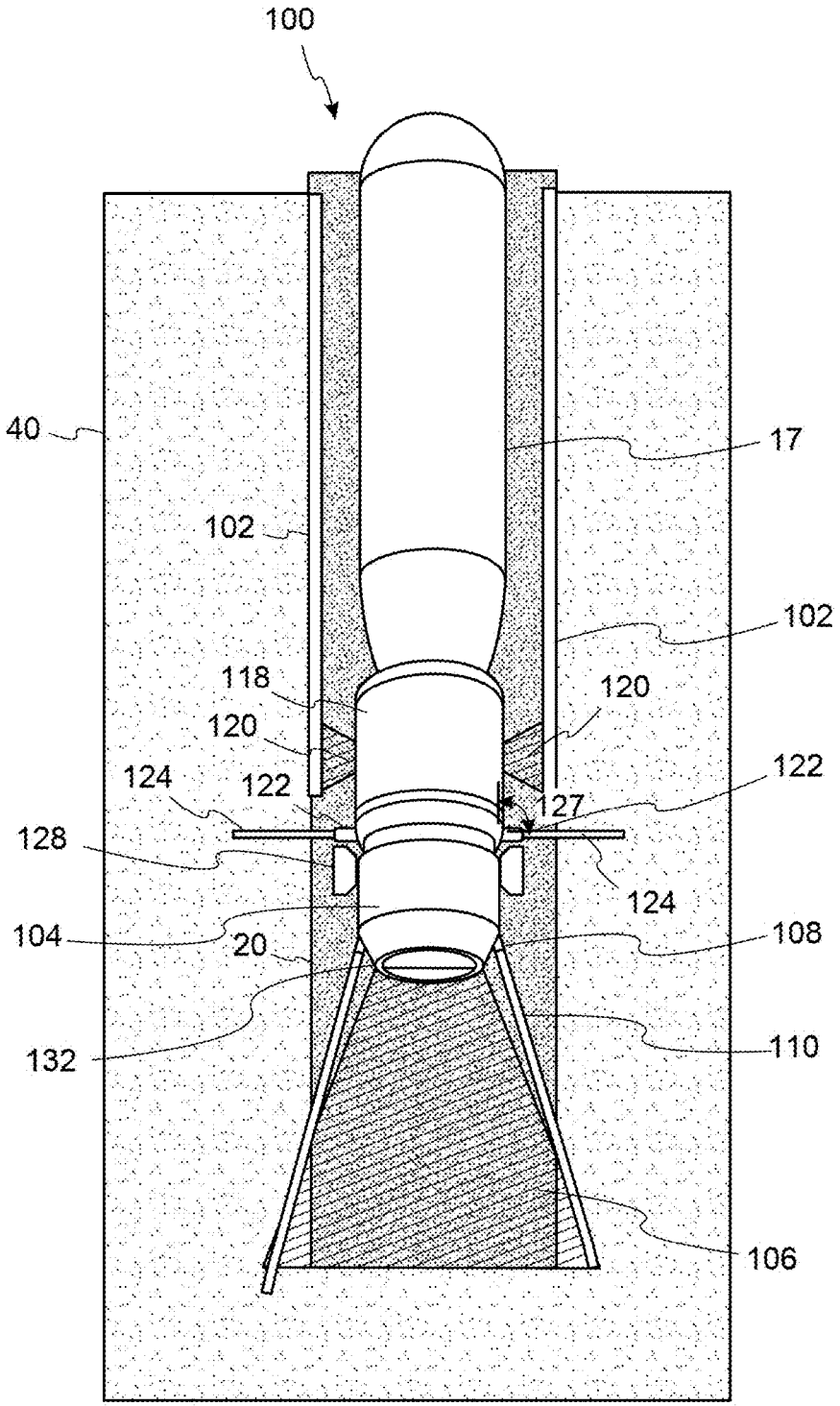
FIGS. 2A, 2B, and 2C are schematic diagrams of the downhole tool for casing a wellbore while drilling.
Figure 2B:
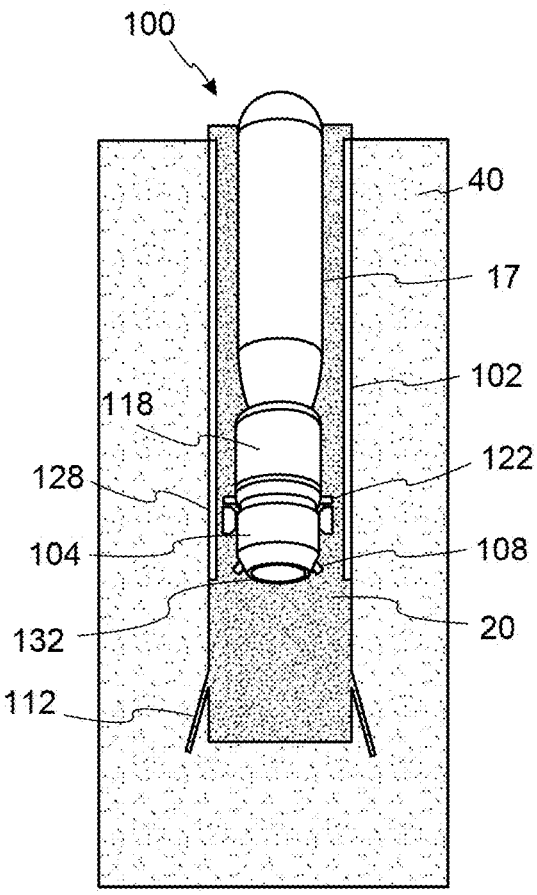
Figure 2C:
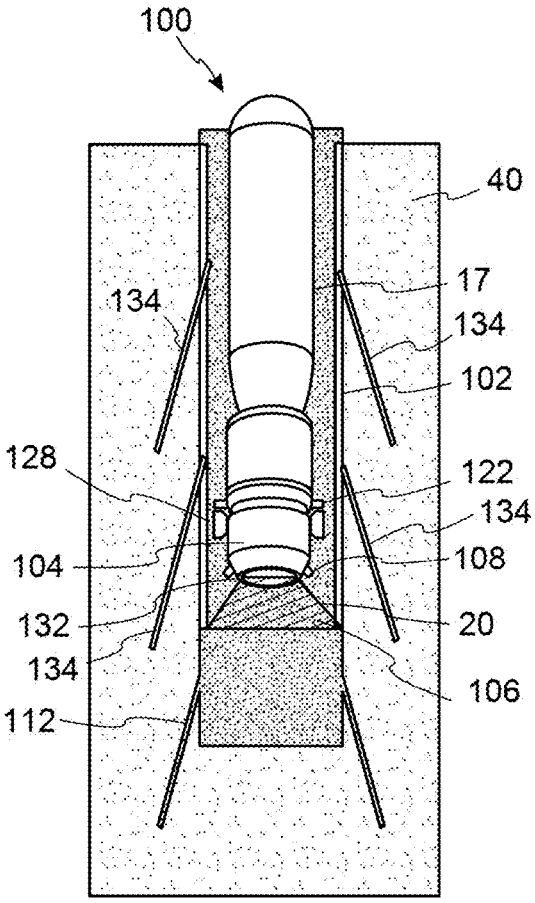

FIGS. 2A, 2B, and 2C show schematic diagrams of the downhole tool 100 for casing a wellbore while drilling. The downhole tool 100 includes high power lasers to rapidly increase the temperature of materials in the wellbore 20 to form the wellbore and/or cause the materials to consolidate and form casing 102. For example, when a laser beam interacts with sandstone, the temperature rapidly raises from room temperature to 2000° C. in 3 seconds, this property can be utilized to create casing for the wellbore while drilling. Use of lasers in drilling operations can be advantageous because lasers can be operated with, for example, precision, reliability, control, and reduced cost. One of the several laser features is that the ability of the laser to rapidly increase of temperature in seconds when interacts with materials, such as rocks and sand, The downhole tool 100 includes a drilling laser head 104 that is configured to emit a drilling laser beam 106 in the downhole direction to form the wellbore 20. The drilling laser beam 106 can be tuned to spall the subsurface formation (e.g., break pieces from the subsurface formation) or vaporize the material in the wellbore. Laser and rock interactions and any resulting phase changes are based on energy imparted from the laser beam to the rock. The laser energy can raise the temperature of the rock. The effect that the laser has on the rock depends at least in part on the temperature increase of the rock. Different rock types can have different behaviors at distinct temperatures. For example, sandstone in can melt at 1400° C., while limestone dissociates at 1100° C. At lower temperatures around 400° C., rock (e.g., sandstone with less than 50% silica, Berea Sandstone) can spall (breaking into small fragments) and at even lower temperatures (e.g., 300° C. to 570° C.), clays will collapse. The drilling laser beam 106 can be adjusted (e.g., adjusting laser intensity or power per area of the laser beam) to achieve the desired effect on the materials in the subsurface formation.

The downhole tool 100 includes a second laser head 108 that emits narrow laser beams 110 to cut angled holes 112 in the subsurface formation. The narrow laser beams 110 have a diameter that is smaller than the drilling laser beam 106. The second laser head 108 is positioned to emit the narrow laser beams 110 at an angle 114 from the central axis 116 of the wellbore 20. The angled holes 112 can be filled with melt to form an anchor or attachment point between well casing formed from the subsurface formation and the sides of the wellbore. The second laser head 108 can be configured to emit the second laser beams 110 to form the angled holes 112 ahead of the drilling laser beam 106.

The downhole tool 100 includes a radial laser head 118 that emits a radial laser beam 120 to be incident on the sides of the wellbore 20. The radial laser head 118 is positioned uphole on the downhole tool 100 relative to the drilling laser head 104 and the second laser head 108. The radial laser beam 120 causes material on the side of the wellbore to consolidate to form the well casing 102. The radial laser beam 120 can also cause material to consolidate in the angled holes 112 to form the anchor or attachment point for the well casing 102.

The downhole tool 100 also includes a fourth laser head 122 that is positioned on the downhole tool 100 between the radial laser head 118 and the second laser head 108. The fourth laser head 122 is configured to emit narrow laser beams 124, which can be similar in diameter to narrow laser beams 110. The fourth laser head 122 includes a rotatable joint 126 that enables the angle 127 between the fourth laser head 122 and the side of the downhole tool 100 to be changed. This allows the fourth laser head 122 to emit the narrow laser beams 124 in a direction different than the narrow laser beams 110. For example, as shown the fourth laser head 122 emits the narrow laser beams 124 in a radial direction. In some implementations (see, e.g., FIG. 7B), the fourth laser head 122 can be positioned to emit the narrow laser beams 124 in the uphole direction to form angled holes in the opposite direction as the angled holes 112. This can create a stronger attachment with the well casing 102. The second and fourth laser heads 108 and 122, respectively, can be rotated relative to each other and the wellbore to from a network of angled holes to form anchors at different angles to more securely attach the wellbore casing 102 to the sides of the wellbore 20.

Between the second laser head 108 and the fourth laser head 122, nozzles 128 are positioned to inject additional filler material into the wellbore. The additional filler material can fill the angled holes 112 and melt to form anchors 130 for the casing 102. The additional filler material can be, for example, sand, quartz, glass beads, silica-based materials, or other suitable material that can be melted by the radial laser beam 120. The downhole tool 100 can include a supply of the additional filler material within the downhole tool 100. Alternatively, the additional filler material can be suppled to the nozzles 128 from the surface through tubing inside the drill string 17. In some implementations, the fourth laser head 122 is configured to emit the narrow laser beams 124 to melt additional filler material in the angled holes 112.

The laser heads 104, 108, 118, and 122 can be connected to a laser source at the surface through a fiber optic cable. The fiber optic cable can transmit the laser light generated at the surface through the drill string 17 to the laser heads 104, 108, 118, and 122. The fiber optic cable can be, for example, a fiber optic cable for a Ytterbium high power laser that is designed to transmit the high power laser light without damaging the fiber optic cable.

The downhole tool 100 can also include purging nozzles 132. The purging nozzles 132 can inject a fluid (e.g., a gas or fluid that allows transmission of the laser beams with minimal absorption) to clear drilling cuttings from the wellbore 20. The purging nozzles 132 can be connected to a supply of the fluid at the surface. In implementations where the drilling laser beam 106 is tuned to vaporize the material in the wellbore, purging nozzles may not be needed.

FIGS. 2B and 2C show a progression of the process of casing the wellbore 20 while drilling. In FIG. 2B, the downhole tool 100 has formed casing 102 along the side of the wellbore 20. The downhole tool 100 has also cut angled holes 112 ahead of the downhole tool 100. In FIG. 2C, the downhole tool 100 has proceeded further downhole forming the wellbore with the drilling laser beam 106. Additionally, the angled holes 112 have been filled with material that has been consolidated to form anchors 134 that attach to the well casing 102. The anchors 134 can retain the well casing 102 in place along the sides of the wellbore 20. The consolidated or melted material in the angled holes can strengthen the attachment of the casing to the wellbore preventing it from detachment.

Figure 3:
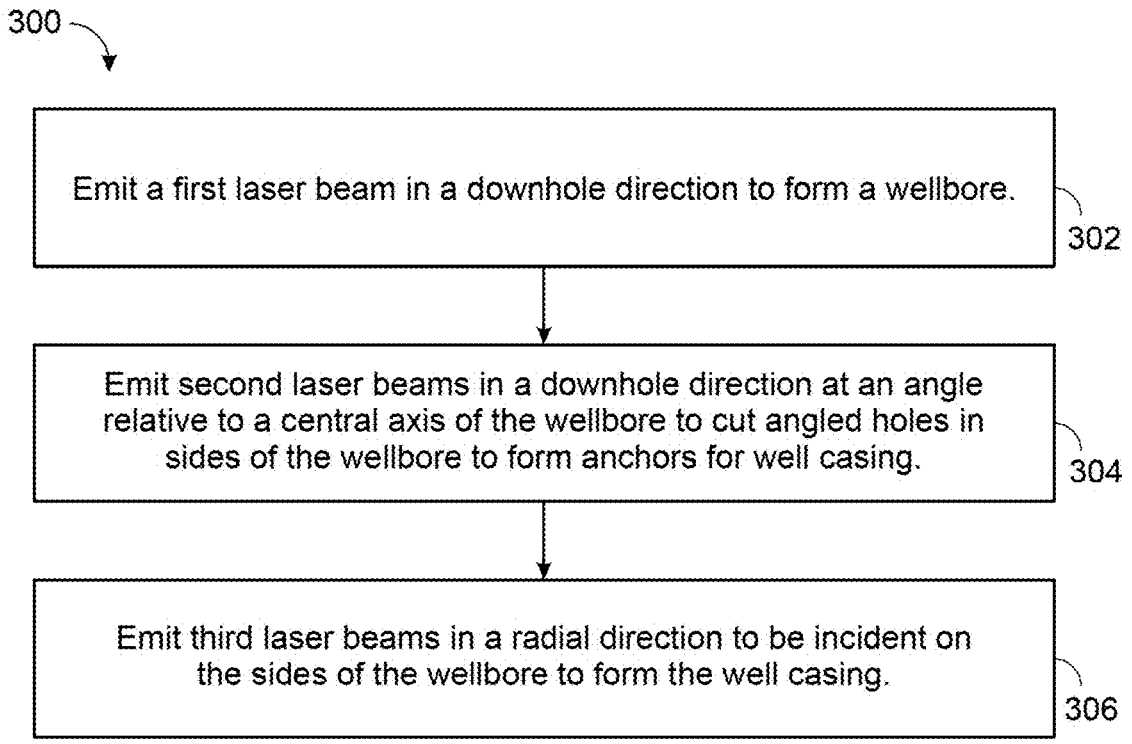
FIG. 3 is a flow chart for a method of casing a wellbore while drilling.

FIG. 3 is a flow chart for an example method 300 of casing a wellbore while drilling. The method 300 can be implemented using, for example, a wellbore drilling assembly including a tool such as downhole tool 100. The downhole tool 100 can be controlled by a data processing system such as a computer system or control system to perform operations in the method 300.

A first laser head mounted to the wellbore drilling assembly is positioned within a wellbore in a subsurface formation. The first laser head emits a first laser beam in a downhole direction within the wellbore (step 302). The first laser beam has a first beam width and causes portions of the subsurface formation to be released as drill cutting in the wellbore. For example, the first laser beam can cause rock in the wellbore to spall or fragment. In some implementations, the first laser beam vaporizes portions of the subsurface formation.

A second laser head emits second laser beams in a downhole direction at an angle relative to a central axis of the wellbore to cut abled holes in sides of the wellbore to form anchors for wellbore casing (step 304). The second laser head is also mounted to the wellbore drilling assembly. The second laser beam has a second beam width smaller than the first beam width.

A third laser head emits third laser beams in a radial direction (step 306). The third laser head is positioned on the wellbore drilling assembly uphole from the second laser head. The third laser beams are incident on the sides of the wellbore to cause material on the sides of the wellbore to consolidate to form the casing of the wellbore. In some implementations, the wellbore drilling assembly injects a filler material into the angled holes using nozzles disposed along sides of the wellbore drilling assembly. The filler material can fill the angled holes and consolidate to form an anchor for the casing.

In some implementations, a fourth laser head is disposed between the second laser head and the third laser head and emits fourth laser beams to cut holes in the side of the wellbore. The fourth laser beams can be similar in size to the second laser beams. In some implementations, the fourth laser head can be rotated relative to the wellbore drilling assembly to change an angle of the holes cut in the side of the wellbore relative to the central axis of the wellbore.

In some implementations, the laser energy is transmitted from a surface of the wellbore to the first, second, third, and/or fourth laser heads through one or more fiber optic cables.

In some implementations, the wellbore drilling assembly injects fluid into the wellbore using purging nozzles to remove drilling cuttings from the wellbore. The fluid can be, for example, a gas (e.g., nitrogen) or other optically transmissive fluid. The laser beams emitted by the laser heads of the wellbore drilling assembly can pass through the fluid injected into the wellbore without being absorbed by the fluid. The fluid injected through the purging nozzles can also function to press the melted or consolidated rock against the sides of the wellbore while forming the casing.

Figure 4:
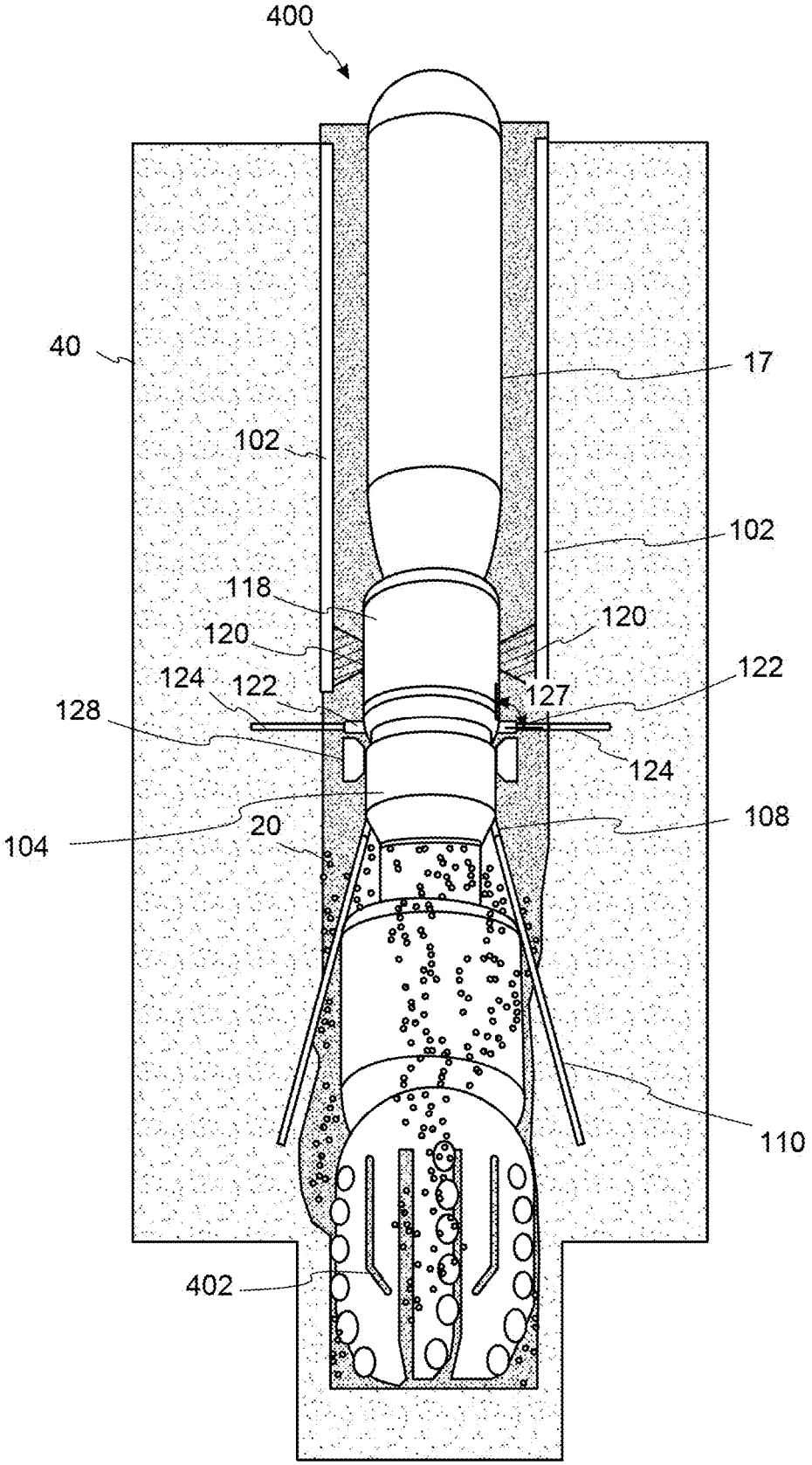
FIG. 4 is a schematic illustration of a downhole tool for casing a wellbore while drilling.

FIG. 4 is a schematic diagram of another example downhole tool 400 for casing a wellbore while drilling. The downhole tool 400 is substantially the same as downhole tool 100 except downhole tool 400 includes a mechanical drill bit 402 in place of the drilling laser head 104. The mechanical drill bit 402 can crush the rocks and break the rocks down into fine grains. The fine grains can then be melted to form the natural casing. In sandstone, the melted grains form a solid glassy material. The mechanical drill bit 402 can form the wellbore while the second laser head 108, radial laser head 118, and fourth laser head 122 consolidate drill cutting and other wellbore material to form the wellbore casing and attach the wellbore casing to the wellbore sides using anchors in the angled holes cut by the second or fourth laser heads. The angles of the second laser head 108 and the fourth laser head 122 can be adjusted to not interfere with or impinge on the mechanical drill bit 402. The downhole tool 400 can be operated using a modified method 300 where step 302 is replaced with rotating the mechanical drill bit (e.g., by rotating the drill string) to form the wellbore.

Figure 5:
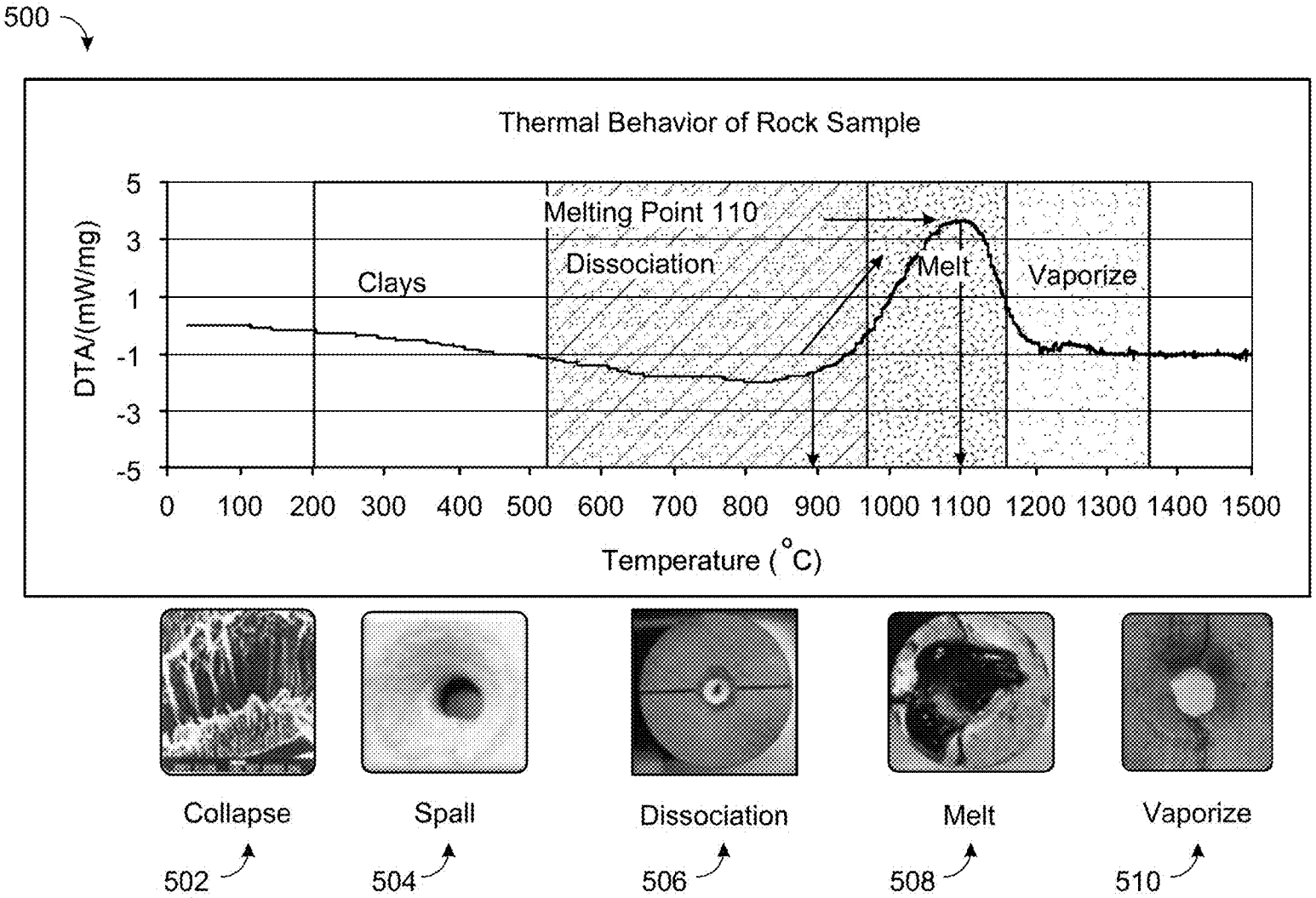
FIG. 5 is a plot of thermal behavior of rock samples.

FIG. 5 is a plot 500 demonstrating effects of temperature on the behavior of limestone rock samples. The laser power for tools forming wellbore casing can be adjusted to achieve the desired rock behavior. In a sandstone formation, the laser power can be tuned to deliver power that allows the rock temperature to reach the melting stage, which for sandstone is 1400° C. Achieving this temperature will melt the grains and consolidate the material to form the well casing. FIG. 5 also includes photographs of different rock behaviors including collapse 502, spall 504, dissociation 506, melt 508, and vaporization 510.

Figure 6B:
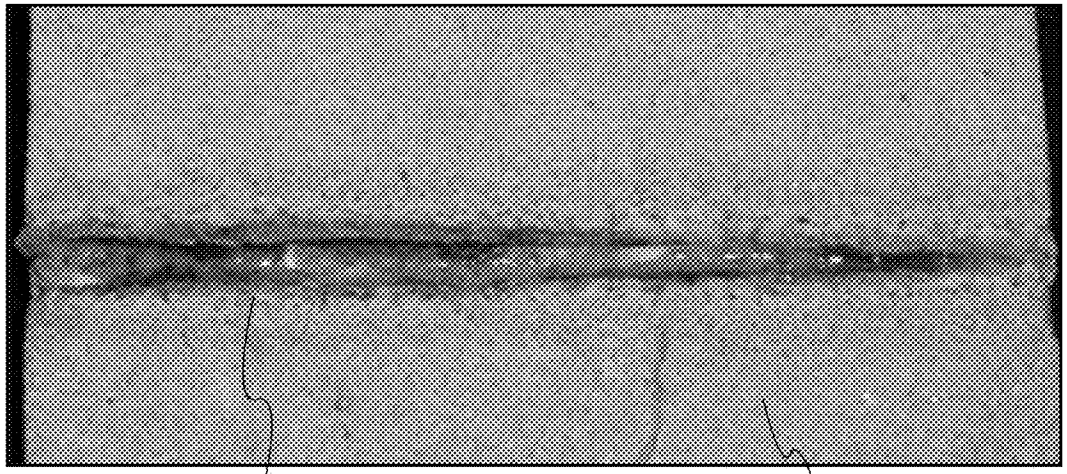
FIGS. 6A and 6B are photographs of a sample natural well casing formed by a laser beam.
Figure 6A:
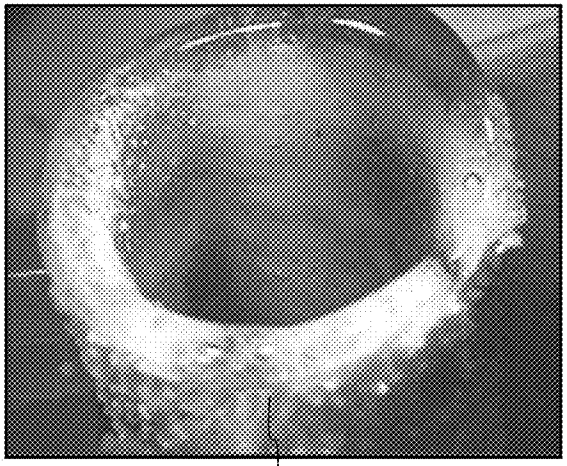

FIGS. 6A and 6B are photographs from an experiment conducted to form casing using a high power laser. The laser power was set at 4 kilowatts (kW), which enabled the melting of sandstone to take place and form a sealed casing 600. FIG. 6A is a top view of a small scale example of casing for a wellbore formed by the laser. The casing is a completely glass structure of fused silica that seals the wellbore. FIG. 6B shows a cross section of the sealed wellbore casing 600 in a sandstone formation 602.

Figure 7A:
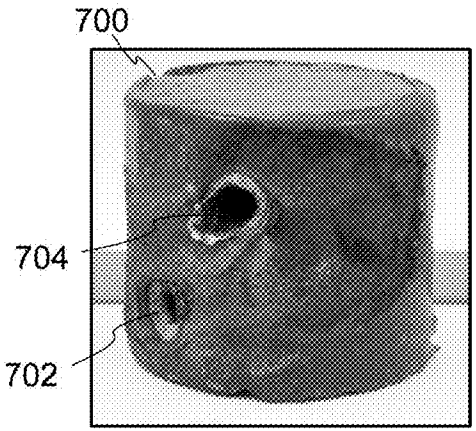
FIGS. 7A and 7B are photographs of angled holes cut by laser beams to improve attachment of natural casing to a wellbore.
Figure 7B:
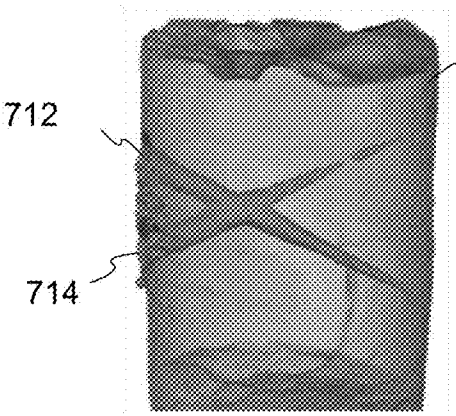

FIGS. 7A and 7B are photographs of samples with crossing narrow holes that can be used to create a strong attachment for natural wellbore casing. FIG. 7A shows a view of an outside of the sample 700 with two holes 702 and 704 cut into the side of the sample 700. FIG. 7B shows a photograph of a second sample 710 that is transparent revealing the crossing holes 712 and 714.

Figure 7C:
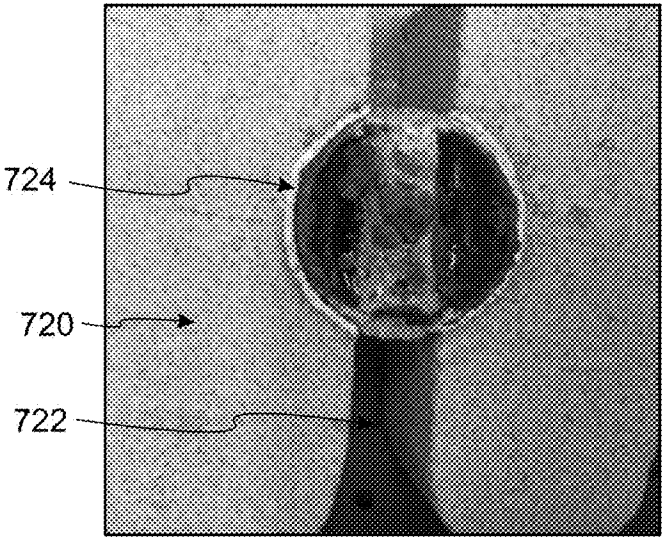
FIGS. 7C and 7D are photographs of additional filler melted to fill holes and attach casing to a subsurface formation.
Figure 7D:
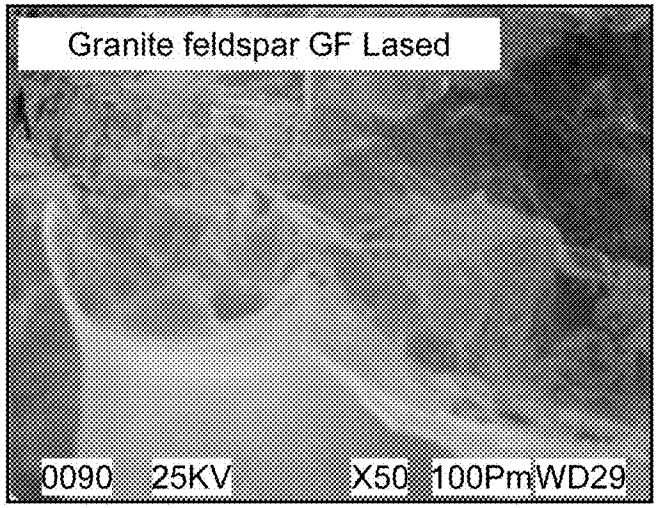

FIGS. 7C and 7D show photographic results from an experiment to evaluate the effectiveness of the additional material (filler) that can be provided to fill the angled holes in the wellbore. The additional material used was sand. The sand was consolidated and melted to attach the rock to the melt and form the casing. The simulated formation 720 was sandstone. The additional material was provided to a fracture 722 and consolidated with a laser beam to form a sealed portion 724 of the fracture 722. A microscopic image was taken of the melt and the rock attachment showing that the melt can be attached to the formation. FIG. 7D shows a micrograph of the melted sand attaching to the formation. The degree of attachment depends on the rock type and permeability, this case happens only on permeable formation.

A number of implementations of these systems and methods have been described. Nevertheless, it will be understood that various modifications may be made without departing from the spirit and scope of this disclosure. Accordingly, other implementations are within the scope of the following examples and claims.

EXAMPLES

In an example implementation, a wellbore drilling assembly includes a first laser head operable to emit a first laser beam in a downhole direction to cause portions of the subsurface formation to be released as drill cuttings into the wellbore; a second laser head operable to emit second laser beams at an angle relative to a central axis of the wellbore to cut angled holes into the sides of the wellbore, the second laser beams having a width that is less than a width of the first laser beam; and a third laser head disposed uphole from the first and second laser heads, the third laser head operable to emit a third laser beam in a radial direction within the wellbore to cause material on a side wall of the wellbore to consolidate and form a casing of the wellbore.

An aspect combinable with the example implementation includes a fourth laser head disposed between the second laser head and the third laser head, the fourth laser head operable to emit fourth laser beams to cut additional holes in the side of the wellbore.

In another aspect combinable with one, some, or all of the previous aspects, the fourth laser head is rotatable relative to the wellbore drilling assembly to change an angle of the holes cut in the side of the wellbore relative to the central axis.

Another aspect combinable with one, some, or all of the previous aspects includes nozzles disposed along a side of the wellbore drilling assembly operable to inject a filler material into the angled holes, the filler material configured to be consolidated within the angled holes to form an anchor for the casing.

Another aspect combinable with one, some, or all of the previous aspects includes purging nozzles operable to inject a fluid into the wellbore to remove drilling cuttings.

Another aspect combinable with one, some, or all of the previous aspects includes one or more fiber optic cables extending from a surface of the wellbore to the first, second and third laser heads.

In another example implementation, a method of casing a wellbore while drilling includes emitting a first laser beam in a downhole direction within a wellbore to cause portions of a subsurface formation to be released as drill cuttings in the wellbore, the first laser beam having a first beam width; emitting second laser beams at an angle relative to a central axis of the wellbore to cut angled holes in sides of the wellbore to form anchors for a casing of the wellbore, the second laser beams having a second beam width smaller than the first beam width; and emitting third laser beams in a radial direction to cause material on the sides of the wellbore to consolidate to form the casing of the wellbore.

An aspect combinable with the example implementation includes emitting fourth laser beams to cut holes in the side of the wellbore uphole from the angled holes cut by the second laser beams.

Another aspect combinable with one, some, or all of the previous aspects includes rotating the fourth laser beams relative to the central axis to change an angle of the holes cut in the side of the wellbore.

Another aspect combinable with one, some, or all of the previous aspects includes injecting a filler material into the angled holes using nozzles disposed along a side of a wellbore drilling assembly.

Another aspect combinable with one, some, or all of the previous aspects includes consolidating the filler material within the angled holes to form an anchor for the casing.

Another aspect combinable with one, some, or all of the previous aspects includes injecting a fluid into the wellbore to remove the drilling cuttings using purging nozzles on a wellbore drilling assembly.

Another aspect combinable with one, some, or all of the previous aspects includes transmitting laser energy from a surface of the wellbore to the first, second and third laser beams through one or more fiber optic cables.

In another example implementation, a wellbore drilling assembly includes a drilling mechanism operable to form a wellbore through a subsurface formation; a first laser head operable to emit first laser beams at an angle relative to a central axis of the wellbore, the first laser beams configured to cut angled holes into the side of the wellbore; and a second laser head operable to emit a second laser beam in a radial direction within the wellbore, wherein the second laser beam, when incident on a side wall of the wellbore causes material on the side wall to consolidate and form a casing of the wellbore.

In an aspect combinable with the example implementation, the drilling mechanism includes a third laser head operable to emit a third laser beam in a downhole direction to form the wellbore, wherein the third laser beam has a width that is wider than the first laser beams.

In another aspect combinable with one, some, or all of the previous aspects, the drilling mechanism includes a mechanical drill bit configured to rotate and drill through the subsurface formation to form the wellbore.

In another aspect combinable with one, some, or all of the previous aspects includes a third laser head disposed on the wellbore drilling assembly in an uphole direction from the first and second laser heads. The third laser head is operable to emit third laser beams to cut additional holes in the side of the wellbore.

In another aspect combinable with one, some, or all of the previous aspects, the third laser head is rotatable relative to the wellbore drilling assembly to change an angle of the additional holes cut in the side of the wellbore relative to the central axis.

In another aspect combinable with one, some, or all of the previous aspects includes nozzles disposed along a side of the wellbore drilling assembly operable to inject a filler material into the angled holes. The filler material is operable to be consolidated within the angled holes to form an anchor for the casing.

In another aspect combinable with one, some, or all of the previous aspects includes purging nozzles operable to inject a fluid into the wellbore to remove drilling cuttings from the wellbore.

What is claimed is:

1. A wellbore drilling assembly comprising:

a first laser head operable to emit a first laser beam in a downhole direction to cause portions of the subsurface formation to be released as drill cuttings into the wellbore;

a second laser head operable to emit second laser beams at an angle relative to a central axis of the wellbore to cut angled holes into the sides of the wellbore, the second laser beams having a width that is less than a width of the first laser beam;

a third laser head disposed uphole from the first and second laser heads, the third laser head operable to emit a third laser beam in a radial direction within the wellbore to cause material on a side wall of the wellbore to consolidate and form a casing of the wellbore; and a fourth laser head disposed uphole from the second laser head and downhole from the third laser head, the fourth laser head operable to emit fourth laser beams to cut additional holes in the side of the wellbore.

2. The wellbore drilling assembly of claim 1, wherein the fourth laser head is rotatable relative to the wellbore drilling assembly to change an angle of the holes cut in the side of the wellbore relative to the central axis.

3. The wellbore drilling assembly of claim 1, further comprising nozzles disposed along a side of the wellbore drilling assembly operable to inject a filler material into the angled holes, the filler material configured to be consolidated within the angled holes to form an anchor for the casing.

4. The wellbore drilling assembly of claim 1, further comprising purging nozzles operable to inject a fluid into the wellbore to remove drilling cuttings.

5. The wellbore drilling assembly of claim 1, further comprising one or more fiber optic cables extending from a surface of the wellbore to the first, second and third laser heads.

6. A method of casing a wellbore while drilling, the method comprising:

emitting a first laser beam in a downhole direction within a wellbore to cause portions of a subsurface formation to be released as drill cuttings in the wellbore, the first laser beam having a first beam width;

emitting second laser beams at an angle relative to a central axis of the wellbore to cut angled holes in sides of the wellbore, the second laser beams having a second beam width smaller than the first beam width; and injecting a filler material into the angled holes using nozzles disposed along a side of a wellbore drilling assembly;

emitting third laser beams in a radial direction to cause the filler material to consolidate in the angled holes and to cause material on the sides of the wellbore to consolidate to form a casing of the wellbore, the consolidated filler material forming anchors for the casing.

7. The method of claim 6, further comprising emitting fourth laser beams to cut holes in the side of the wellbore uphole from the angled holes cut by the second laser beams.

8. The method of claim 7, further comprising rotating the fourth laser beams relative to the central axis to change an angle of the holes cut in the side of the wellbore.

9. The method of claim 6, further comprising injecting a fluid into the wellbore to remove the drilling cuttings using purging nozzles on a wellbore drilling assembly.

10. The method of claim 6, further comprising transmitting laser energy from a surface of the wellbore to the first, second and third laser beams through one or more fiber optic cables.

11. A wellbore drilling assembly comprising:

a drilling mechanism operable to form a wellbore through a subsurface formation;

a first laser head operable to emit first laser beams at an angle relative to a central axis of the wellbore, the first laser beams configured to cut angled holes into the side of the wellbore;

a second laser head disposed in an uphole direction from the first laser head, the second laser head operable to emit a second laser beam in a radial direction within the wellbore, wherein the second laser beam, when incident on a side wall of the wellbore causes material on the side wall to consolidate and form a casing of the wellbore; and a third laser head disposed in an uphole direction from the first laser head and in a downhole direction from the second laser head, the third laser head operable to emit third laser beams to cut additional holes in the side of the wellbore.

12. The wellbore drilling assembly of claim 11, wherein the drilling mechanism comprises a fourth laser head operable to emit a fourth laser beam in a downhole direction to form the wellbore, wherein the fourth laser beam has a width that is wider than the first laser beams.

13. The wellbore drilling assembly of claim 11, wherein the drilling mechanism comprises a mechanical drill bit configured to rotate and drill through the subsurface formation to form the wellbore.

14. The wellbore drilling assembly of claim 11, wherein the third laser head is rotatable relative to the wellbore drilling assembly to change an angle of the additional holes cut in the side of the wellbore relative to the central axis.

15. The wellbore drilling assembly of claim 11, further comprising nozzles disposed along a side of the wellbore drilling assembly operable to inject a filler material into the angled holes, the filler material operable to be consolidated within the angled holes to form an anchor for the casing.

16. The wellbore drilling assembly of claim 11, further comprising purging nozzles operable to inject a fluid into the wellbore to remove drilling cuttings from the wellbore.

* * * * *